US006718860B2

(12) United States Patent
Mitsukawa et al.

(10) Patent No.: US 6,718,860 B2
(45) Date of Patent: Apr. 13, 2004

(54) METHOD AND APPARATUS FOR MAKING HOLES IN PIPE

(75) Inventors: Kazuhiro Mitsukawa, Bisai (JP); Takao Ikeda, Okazaki (JP); Kunio Yamada, Chiryu (JP)

(73) Assignee: Denso Corporation, Kariya (JP)

( * ) Notice: Subject to any disclaimer, the term of this patent is extended or adjusted under 35 U.S.C. 154(b) by 59 days.

(21) Appl. No.: 09/950,063

(22) Filed: Sep. 12, 2001

(65) Prior Publication Data

US 2002/0029474 A1 Mar. 14, 2002

(30) Foreign Application Priority Data

Sep. 12, 2000 (JP) ..... 2000-276935

(51) Int. Cl.[7] ..... B26D 9/00

(52) U.S. Cl. ..... 83/862; 83/30; 83/39; 83/54; 83/682; 72/325

(58) Field of Search ..... 72/325; 83/30, 83/33, 39, 54, 917, 919, 682, 685, 862, 660, 684, 686, 687, 689, 688, 690, 697, 318, 319; 30/358, 359, 360, 366

(56) References Cited

U.S. PATENT DOCUMENTS

| | | | | | |
|---|---|---|---|---|---|
| 2,811,738 | A | * | 11/1957 | Gall | 15/328 |
| 3,120,143 | A | * | 2/1964 | Kreider | 83/454 |
| 3,580,269 | A | * | 5/1971 | Ehrens et al. | 137/318 |
| 3,841,189 | A | * | 10/1974 | Spengler et al. | 83/660 |
| 4,189,964 | A | * | 2/1980 | Gray | 30/241 X |
| 4,608,754 | A | * | 9/1986 | Kloster | 30/92 |
| 4,796,498 | A | * | 1/1989 | Borzym | 83/49 |
| 4,930,384 | A | * | 6/1990 | Nakatsuji | 83/54 |
| 4,974,436 | A | * | 12/1990 | Nakatsuji | 72/326 |
| 5,237,899 | A | * | 8/1993 | Schartinger | 83/454 |
| 5,323,538 | A | * | 6/1994 | Sutterlin | 30/366 |
| 5,421,086 | A | * | 6/1995 | Le Gauyer | 29/890.053 |
| 5,431,078 | A | * | 7/1995 | Ricard et al. | 83/870 |
| 5,517,744 | A | * | 5/1996 | Moser et al. | 29/525 |
| 6,003,715 | A | * | 12/1999 | Harris | 220/277 |
| 6,067,830 | A | * | 5/2000 | Klages et al. | 72/55 |
| 6,199,464 | B1 | * | 3/2001 | Chua et al. | 83/13 |

FOREIGN PATENT DOCUMENTS

| | | | | |
|---|---|---|---|---|
| EP | 0083164 A1 | * | 7/1982 | B29C/17/10 |
| JP | 60-072620 | * | 4/1985 | |
| JP | A-4-327323 | | 11/1992 | |
| JP | 10-195865 | * | 7/1998 | |

OTHER PUBLICATIONS

Patent Abstracts of Japan, vol. 006, No. 263 of JP Publication No. 57–156842 dated Sep. 28, 1982.
Patent Abstracts of Japan, vol. 009, No. 213 of JP Publication No. 60–072620 dated Apr. 24, 1985.
Patent Abstracts of Japan, vol. 017, No. 164 of JP Publication No. 04–327323 dated Nov. 16, 1992.

* cited by examiner

*Primary Examiner*—Allan N. Shoap
*Assistant Examiner*—John Windmuller
(74) *Attorney, Agent, or Firm*—Harness, Dickey & Pierce, PLC

(57) ABSTRACT

A method for forming a plurality of slits in a tube includes first, forming a plurality of grooves in the pipe by operating a grooving punch along the length of each of the slits to be made. Then, each slit is formed in the pipe by operating a hole-making punch. The punch has ends at an acute angle and the punch is recessed from the ends toward the center thereof. In view of the fact that each groove is formed beforehand in the surface of the pipe and that the corresponding slit is made while moving the hole-making punch slowly from the ends, a large load is not exerted on the pipe and therefore the pipe is not crushed, burrs are not generated and the cutting chip is removed.

7 Claims, 8 Drawing Sheets

METHOD AND APPARATUS FOR MAKING HOLES IN PIPE

BACKGROUND OF THE INVENTION

1. Field of the Invention

The present invention relates to a method and an apparatus for making holes (or punching) in a pipe and, in particular, to a method suitable for making narrow and elongate slits in a pipe, made of an aluminum alloy, or the like, of low rigidity and having an elliptical section, used for producing a header tank of a heat exchanger.

2. Description of the Related Art

In recent years, with the decrease in the sizes of air-conditioning systems and automotive heat exchangers, pairs of header tanks arranged on the vertical sides or lateral sides of the heat exchangers are made from a comparatively compact pipe having an elliptical section in place of a pipe having a circular section. In order to exchange heat between the header tanks and the atmospheric air by supplying a fluid like water or a refrigerant, the flat end portions of a multiplicity of core tubes are mounted on the header tanks. The portions of the header tanks where the core tubes are mounted are formed with slits by press-work. The flat ends of the tubes are inserted into these holes, and the gaps between the tubes and the holes are closed by brazing. In this case, the pipe having an elliptical section (hereinafter sometimes referred to as an elliptical pipe) making up each header tank cannot be easily formed with slits by pressing, in view of the fact that the pipe is made of such a soft and easily deformable material as an aluminum alloy and has a low rigidity due to the elliptical and flat section leading to a small section modulus, thereby posing the problem that the pipe is liable to be crushed under the load exerted when making holes.

In a method for coping with this problem, a pipe having an elliptical section making up a header tank is fabricated as a structure segmented into two longitudinal portions, and each of the two pipe portions is formed with slits by pressing, after which the two pipe portions are coupled with each other to complete a header tank. This method makes it easy to make slits. Nevertheless, the two or more portions making up each header tank are required to be fabricated separately from each other, and a process is required to couple the pipe portions mainly along a long longitudinal line. Further, the joints of the two pipe portions are always accompanied by the possibility of fluid leakage, and therefore the reliability of this segmented structure is lower than that of the integrated structure.

The method disclosed in Japanese Unexamined Patent Publication No. 4-327323 is known as a first conventional technique usable for fabricating a header tank of the heat exchanger having a multiplicity of slits. According to this technique, a long die and a long metal core for supporting the die are inserted into a pipe having a circular section to constitute a header tank, and a multiplicity of slits are made by pressing while preventing the pipe from being crushed. The work actually capable of being machined by this conventional method is limited to a pipe having a circular section and does not include a pipe having an elliptical section. The reason is that the internal space of the pipe having an elliptical section is so limited that a very thin die and a very thin metal core are required for insertion into such an internal space and it is difficult to secure the strength of the die and the metal core.

In view of this, Japanese Unexamined Patent Publication No. 60-72620 discloses a method, known as the second conventional technique, for making holes in a pipe by pressing without using a die or a metal core. In making circular holes in a pipe 8 having a circular section using this conventional technique, the first step, as shown in FIGS. 2A and 2B, is to form a groove 9 reducing the thickness of a part of the pipe 8 and then a circular hole is punched through, by a circular punch 10, within the range of the groove 8. According to the second conventional technique, the pipe 8 having a circular section has a comparatively high rigidity, and the area with a thickness reduced by the groove where a hole is made by the punch 10 is small. Therefore, the likelihood of completely making a hole is high before the pipe 8 is crushed and deformed. An attempt to make slits in a pipe material having an elliptical section by use of this conventional technique, however, would encounter the various problems described below and end in failure.

The first problem, which arises when attempting to make slits in a pipe having an elliptical section by use of the second conventional technique, is derived from the fact that the rigidity of the pipe having an elliptical section is lower than that of the pipe having a circular section. A simple application of the second conventional technique to the pipe having an elliptical section, therefore, would only deform the pipe and could not make slits as intended.

Specifically, as shown in FIG. 3, a groove 9 constituting a base for making slits in a pipe 1 having an elliptical section is formed along the long diameter on the substantially flat surface portion of the pipe having an elliptical section comparatively large in radius of curvature. At the same time, the horizontally long area of the groove 9 is struck vertically by a punch 12 having a uniformly long cutting edge normally used for punching a slit. In view of the fact that this portion of the elliptical pipe 1 has such a section modulus that the rigidity is small especially against the vertical load, the deformation $\Delta d$ due to the load is increased and the pipe 1 is liable to be easily crushed with the result that slits cannot be made as intended.

To cope with this situation, a punch with a longitudinally slanted cutting edge is effectively used. A punch 13 having a V-shaped cutting edge as shown in FIG. 4 is used, for example, and the cutting position is slowly moved along the direction of the cutting edge. In this way, the problem which otherwise might be caused by the whole length of the cutting edge acting on the surface of the pipe 1 is avoided thereby to reduce the amount of the load exerted vertically on the surface of 10 the material within a unit time. The cutting edge of the punch 13 shown in FIG. 4, which has an acute central peak and two ends formed at an obtuse angle $\theta$, is provided with right and left cutting edge portions in the shape of V. By using this punch 13, therefore, the deformation $\Delta d$ under the load is reduced as compared with the case of FIG. 3, and the pipe 1 can be prevented from being crushed. In this way, an intended slit 7 can be formed in the surface of the elliptical pipe 1 which is grooved appropriately.

The use of the punch 13 having a V-shaped cutting edge, however, as shown in FIG. 4, poses another problem that burrs 14 are formed at the ends of the slit 7 as shown and the periphery of the hole is slightly deformed, resulting in a deteriorated product quality.

This problem can be obviated by the using a special punch 5 which, as shown in FIG. 5, has a cutting edge with a recessed central portion and peaked ends formed at an acute angle $\theta$ slanted in the shape of inverted V inward from the left and right ends toward the central portion thereof. The use of this punch 5 reduces the load exerted vertically on the surface of the work and thus reduces the deformation Δd. At the same time, there is a lower possibility of the burrs 14 being formed at the positions shown in FIG. 4 or of the periphery of the hole being partially deformed, thereby making it possible to successfully form a slit 7 in the elliptical pipe 1.

Nevertheless, a second problem posed by the second conventional technique used for making the slit 7 in the pipe 1 having an elliptical section is that the slit 7 is so narrow and elongated that a similarly narrow and elongate cutting chip generated as the slit 7 is made is not easily separated from the pipe 1 and may often partly remain attached on the periphery of the slit 7. In the case where an inverted-V recessed punch 5 as shown in FIG. 5 is used, therefore, though not formed with the burrs 14 shown in FIG. 4, the hard-to-separate cutting chip 15 is liable to remain on a part of the periphery of the slit 7, as shown in FIG. 5.

Specifically, as shown in FIG. 2B, even in the second conventional technique which uses the circular punch 10 for the pipe 8 having a circular section, the cutting chip 11 generated hen punching a circular hole by the circular punch 10 is not separated and is liable to remain attached to a part of the periphery of the hole for lack of a die and a metal core. This trend is enhanced in the case where the second conventional technique is used for making the slit 7 in the pipe 1 having an elliptical section, in which case the slit 7 is elongated but has a width As small as, say, not more than 1.6 mm. Even the inverted-V recessed punch 5 cannot hold the cutting chip 15 between the left and right cutting edge portions thereof when making the slit 7. As a result, the cutting chip 15 often remains attached to a part of the periphery of the slit 7 without dropping in a curled form.

A third problem Encountered when the second conventional technique is used for making slits in a pipe having an elliptical section is that the absence of a die and a metal core for presswork makes it impossible to form a slanted surface connected with the entrance of the slit 7 at the same time as the press-work. In the case where the conventional technique is used to make a multiplicity of slits 7 in the header tank for producing a heat exchanger, for example, a slanted surface is desirably formed as a guide surface at the entrance of each slit 7 at the same time as the slit 7 is formed, to facilitate the assemblage of core tubes on the header tank in a subsequent step. This is impossible, however, unless a special subsequent step is added in the second conventional technique. The addition of such a second subsequent step would of course increase the processing time and cost.

As described above, in order to solve the problem posed when the method shown in FIG. 3 is employed as an application of the second conventional technique, the method shown in FIG. 4 or 5 may be used for the elliptical pipe 1. To form a slanted surface providing a guide surface at the entrance of each slit 7 for assembling the core tubes, the periphery of the hole 7 is required to be machined additionally in another pressing step or another cutting step after making the slit 7. If the slanted surface is formed at the same time as the slit 7 by press-work, the load for forming the slanted surface is added to the load exerted for making the slit 7 in the elliptical pipe 1. Unless a die and a metal core are used, therefore, the elliptical pipe 1 would be crushed. Thus, neither the slanted surface nor the slit 7 can be formed.

SUMMARY OF THE INVENTION

As evident from the foregoing description, an unavoidable problem is posed not only by the first and second conventional techniques themselves but also by the aforementioned conceivable cases of application or improvement thereof. Accordingly, the object of the present invention is to provide a novel method and a novel apparatus for making holes in a pipe which are capable of obviating the aforementioned problems of the conventional techniques and an application and improvement thereof.

Specifically, the present invention is intended to provide a novel method and a novel apparatus for making holes in a pipe, having an elliptical section and being low in rigidity, in which a multiplicity of slits can be efficiently and easily formed by press-work without using any die or metal core in the pipe. The present invention is also intended to separate the cutting chip positively from the pipe, and thus to prevent the cutting chip from remaining attached to the periphery of the hole to facilitate removal. The present invention is further intended to facilitate the insertion of the end of the core tubes into the slits in a subsequent step by forming a slanted surface at the entrance of the slit at the same time that the slit is formed by the press-work thereby to reduce both the number of steps and the production cost.

According to a first aspect of the invention, there is provided, as a means for solving the problems mentioned above, a method of making holes in a pipe comprising the steps described below.

The method of making holes in a pipe according to the invention comprises at least a grooving step and a hole-making step. In the grooving step, a grooving punch having a predetermined sectional shape is operated in a direction coinciding with the longitudinal direction of the slit to be made in a pipe having an elliptical section, and by scraping off a part of the solid portion of the pipe to such a degree as not to cut through the pipe, a groove is formed in a direction coinciding with the longitudinal direction of the slit. In the hole-making step following the grooving step, a hole-making punch with a cutting edge slanted in longitudinal direction, or preferably, a hole-making punch, having the ends formed at an acute angle and a central portion recessed from the ends thereof, is operated in the direction perpendicular to the longitudinal direction of the groove thereby to form a slit in a pipe having an elliptical section in the substantial area of the groove formed in the grooving step.

The sectional shape of the pipe constituting the work material is elliptical and, therefore, the rigidity of the pipe is low. Even in the case where the pipe would otherwise be crushed by an attempt to form a slit with a slit-making punch, therefore, the load is not exerted over the whole range of the groove at a time, in view of the fact that the area where an intended slit is to be made is grooved in the grooving step and reduced in thickness beforehand, that the slit is made by a hole-making punch with a longitudinally slanted cutting edge preferably having the ends formed at an acute angle and a recessed central portion and that the cutting position is moved longitudinally of the groove in such a manner as to make the slit from the ends progressively toward the central portion. As a result, a comparatively small load is exerted on the pipe having an elliptical section within a unit time, and therefore the pipe is prevented from being crushed under the load. In this way, a narrow, elongate slit can be made by press-work, without a die and a metal core, in the surface of an elliptical pipe having a large radius of curvature along the long diameter of the pipe section.

In the method of making holes in a pipe according to this invention, the slit can be correctly made if the length of the groove is at least 80% of the length of the slit. Even though the range of making a slit is enlarged to an area slightly larger than the groove length, the load exerted on the elliptical pipe is comparatively small and therefore the elliptical pipe is not crushed under the load, in view of the fact that the end portions of the groove are harder to crush than the central portion thereof and that the cutting position of the longitudinally slanted cutting edge moves slowly.

In the method of making holes in a pipe according to the invention, a ridge is formed longitudinally to the groove on the bottom surface of the groove in the first grooving step. In the hole-making step, therefore, the cutting chip generated by the hole-making punch is prevented from remaining attached on the periphery of the slit and is easily separated and discharged from the pipe material. Also, in the case where a chamfer-like slanted surface connected with the side surface of the groove is formed at the same time that the groove is formed by the grooving punch in the grooving step, the slanted surface remains at the entrance of the slit when the slit is made in the hole-making step. In the case where the forward end of another member such as a core tube is required to be inserted into a corresponding slit, the slanted surface guides the forward end of the particular member and facilitates the insertion. Thus, the member can be assembled both easily and rapidly.

According to a second aspect of the invention, there is provided, as a means for solving the problems mentioned above, an apparatus having the configuration described below.

The apparatus for making holes in a pipe according to the invention comprises at least a grooving punch and a hole-making punch. The grooving punch is operated in the grooving step in a direction coinciding with the longitudinal direction of the slit to be made in a pipe having an elliptical section, and by scraping off a part of the solid portion of the pipe to such a degree as not to cut through the pipe, a groove is formed in a direction coinciding with the longitudinal direction of the slit. The hole-making punch has a cutting edge, which is slanted in longitudinal direction, or preferably, has the ends formed at an acute angle and recessed toward the central portion. In the hole-making step following the grooving step, the grooving punch is operated in the direction perpendicular to the longitudinally of the groove within the substantial groove area formed in the grooving step thereby to make a slit in a pipe having an elliptical section.

The sectional shape of the pipe constituting the work material is elliptical and therefore the rigidity of the pipe is low. Even in the case where the pipe would otherwise be crushed by an attempt to make a slit with a slit-making punch, however, the load is not exerted over the whole range of the groove at a time, in view of the fact that the area where an intended slit is to be made is grooved and reduced in thickness beforehand, that the cutting edge of the hole-making punch is slanted longitudinally and preferably has the ends formed at an acute angle and recessed toward the central portion thereof and that the cutting position is moved longitudinally of the groove in such a manner as to make a slit from the ends progressively toward the central portion. As a result, a comparatively small load is exerted on the pipe having an elliptical section within a unit time, and therefore the pipe is prevented from being crushed under the load. In this way, a narrow and elongate slit can be made successfully by the press-work, without a die and a metal core, in a surface of a pipe, having an elliptical section, which has a large radius of curvature along the long diameter of the pipe section.

With the apparatus for making holes in a pipe according to this invention, a preferable hole-making punch can be used which is recessed either in the shape of inverted V or inverted W. As a result, the slit begins to be made from the ends of the groove formed in the grooving step and therefore no burrs are left attached. Also, the cutting position of the cutting edge of the hole-making punch moves longitudinally to the slit at such a rate that the crushing of the elliptical pipe having a low rigidity, which otherwise might be caused by a large load exerted on the pipe, can be avoided. Further, in the case where a groove is formed between the cutting edge portions with at least a part of the central portion recessed along the thickness of the cutting edge, the cutting chip supported and curled by the groove is prevented from remaining attached to the peripheral edge of the slit.

With the apparatus for making holes in a pipe according to this invention, the slit can be correctly made if the length of the groove is at least 80% of the length of the slit. Even though the slit-making range is enlarged to an area slightly larger than the groove length, the load exerted on the elliptical pipe is comparatively small and therefore the elliptical pipe is not crushed under the load, in view of the fact that the end portions of the groove are harder to crush than the central portion thereof and that the cutting edge is slanted longitudinally and the cutting position moves longitudinally.

With the hole-making apparatus according to the invention, a recess like a groove can be formed along the lower edge portion of the grooving punch. As a result, a longitudinal ridge is formed on the groove bottom in the grooving step. The portion along the lines on the sides of the ridge is reduced in thickness along the length of the groove. In the hole-making step, therefore, the cutting edge of the hole-making punch is applied along the thinner portion on the side lines of the ridge, so that this particular portion is cut first. Thus, the cutting chip is separated more easily from the periphery of the slit.

On the other hand, provision of a slanted surface on at least one side of the grooving punch can automatically form, at the time of forming the groove, at least one chamfer-like slanted surface at the portion constituting the entrance of the slit connected to the groove side. This slanted surface acts as a guide surface for guiding the forward end of another member, which may be required to be inserted into the slit, and thus facilitates the insertion. As a result, the members can be assembled with rapidity. According to this invention, however, such a slanted surface need not be formed intentionally but can be automatically formed in the grooving step. Therefore, neither the number of steps nor the cost is increased.

The above and other objects, features and advantages will be made apparent by the detailed description of embodiments taken in conjunction with the accompanying drawings.

DESCRIPTION OF THE PREFERRED EMBODIMENTS

Figure 1A:
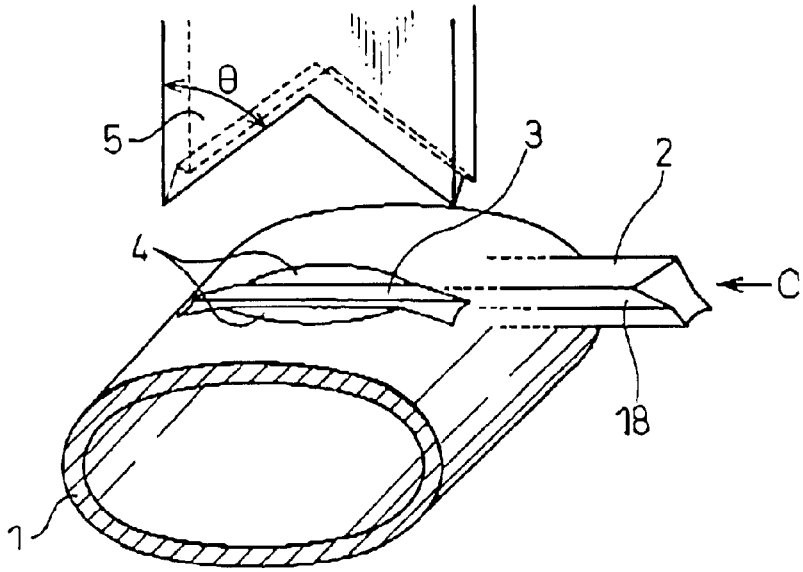
FIGS. 1A to 1C are perspective views showing a method of making a hole in a pipe as steps in a time series according to the most preferable embodiment of the invention.
Figure 1B:
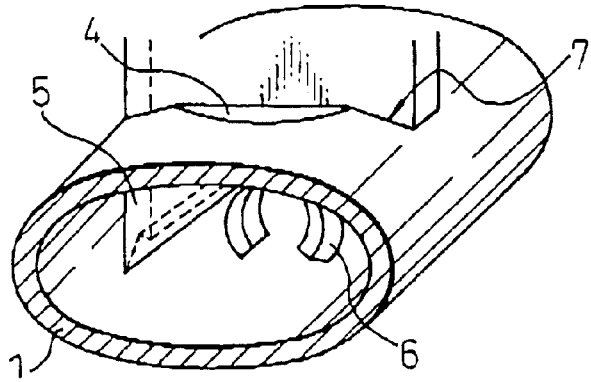
Figure 1C:
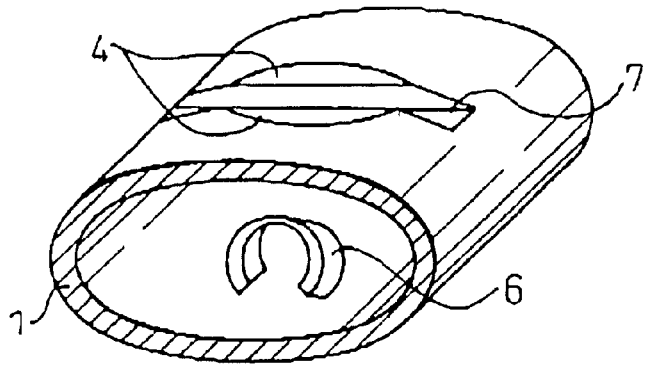
Figure 2A:
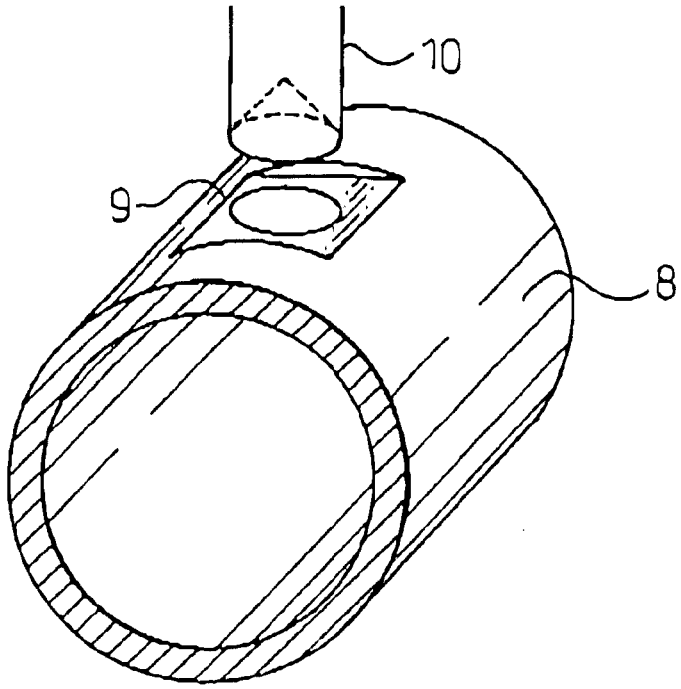
Fig.2A PRIOR ART
FIGS. 2A and 2B are perspective views showing a method of making a hole in a pipe as steps in a time series according to the second conventional technique.
Figure 2B:
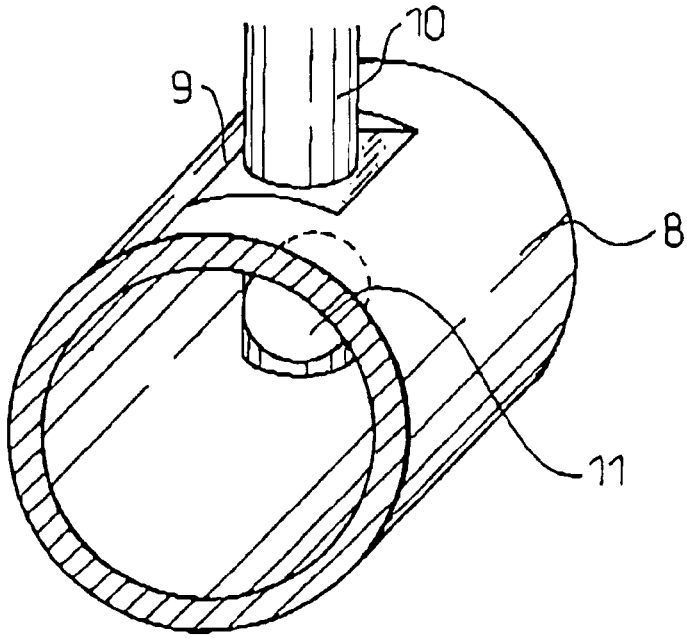
Fig.2B PRIOR ART
Figure 4:
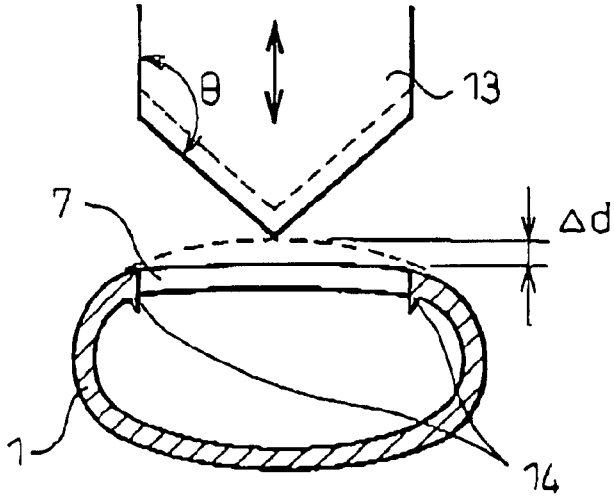
FIG. 4 is a sectional view for explaining the problem posed when using a punch protruded in the shape of a V.
Figure 5:
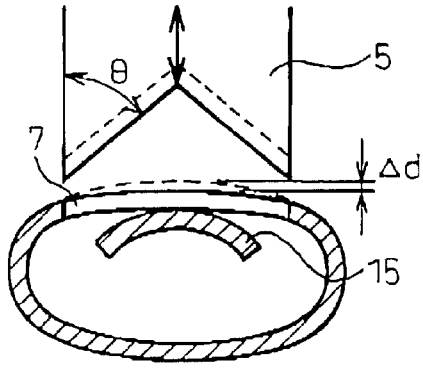
FIG. 5 is a sectional view for explaining the problem posed when using a punch recessed in the shape of an inverted V.

The present invention can be embodied by use of a hole-making punch, in a shape shown in FIGS. 4 and 5, which was explained with reference to the prior art. The most preferable embodiments of the invention, however, are shown in FIGS. 1A to 1C. FIG. 1A shows a grooving step corresponding to the first half of the process of the method of making a hole in a pipe according to the invention, and FIG. 1B a hole-making step corresponding to the last half of the process of the, method of making a hole according to the invention. FIG. 1C illustrates an elliptical pipe as a product (or a product in process) after the completion of all the steps and the state of the cutting chip generated.

First, in the grooving step shown in FIG. 1A, a comparatively flat surface of the pipe 1 having an elliptical section is shaped by moving a grooving punch 2 having a special sectional shape along the length of a slit to be made. In this way, a part of the elliptical pipe 1 is scraped off thereby to form a groove 3 having a section of substantially the same shape as that of the grooving punch 2. The grooving operation, however, is only for reducing the thickness, of the pipe portion involved, appropriately but is not required to be performed to such a degree as to cut a through hole in the pipe having an elliptical section. In the presence of a portion having a smaller thickness, a lesser load is exerted over the whole elliptical pipe 1 when forming a hole therein in a subsequent step. Therefore, the elliptical pipe 1 having a low rigidity can be prevented from being crushed.

Figure 6A:
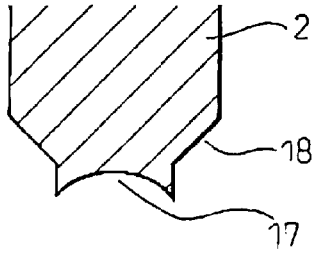
FIGS. 6A and 6B are sectional views illustrating the sectional shapes of different grooving punches, respectively, adapted for use according to this invention.
Figure 6B:
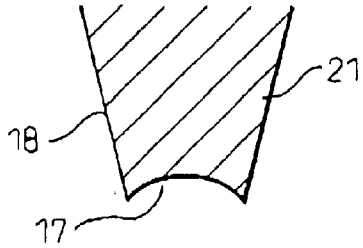

The elongate grooving punch 2 has substantially the same shape of the cross section at any position along the length thereof. Such a shape of the cross section is shown in FIG. 6A as a view taken from the direction of arrow C in FIG. 1A. FIG. 6B shows the shape of a section of the grooving punch 21 constituting a modification of the grooving punch 2. The grooving punches 2 and 21 exhibit substantially similar functions and effects and either one of them can be used in the embodiments of the invention. A first feature shared by the grooving punches 2 and 21 is the presence of a recess 17 similar to a long groove formed along the lower edge portion thereof. A second feature shared by the grooving punches 2 and 21 are the provision of slanted surfaces 18 on the two sides thereof. The grooving punch 2 shown in FIG. 6A and the grooving punch 21 shown in FIG. 6B, however, have different positions, ranges and angles of the formed slanted surfaces 18.

Figure 7:
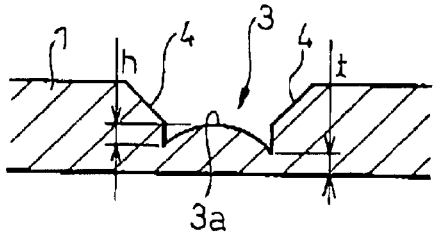
FIG. 7 is a sectional view illustrating a groove formed in the grooving step of a method of forming holes in a pipe, according to this invention.

The sectional shape of the groove 3 formed in the surface of the elliptical pipe 1 by the grooving punch 2 having the sectional shape shown in FIG. 6A is shown in FIG. 7. The provision of the slanted surfaces 18 of the grooving punch 2 automatically forms the slanted surfaces 4, in such a shape, as chamfered portions on the sides of the groove 3 formed in the elliptical pipe 1 in the grooving step. Also, due to the recess 17 at the forward end of the grooving punch 2, a ridge 3*a* is formed over the whole length of the bottom of the groove 3 in the elliptical pipe 1. The height of the ridge 3*a* is designated by h and the thickness of the remaining portion of the elliptical pipe 3 reduced by the groove 3 is designated by t. The sectional shape of the groove formed by the grooving punch 21 shown in FIG. 6B is substantially similar to that of the groove 3 shown in FIG. 7 and will not be explained.

Figure 8A:
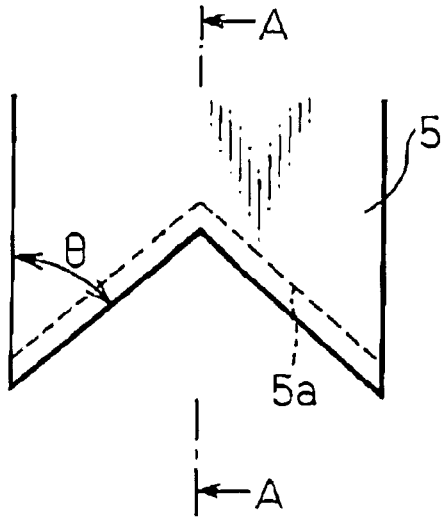
FIG. 8A is a front view showing a punch recessed in the shape of an inverted V adapted for use according to this invention.
Figure 8B:
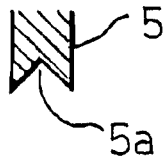
FIG. 8B is a side sectional view taken in line A—A of the same punch.

In the hole-making step shown in FIG. 1B, a slit 7 is punched through by the punch 5 having a shape as shown in FIGS. 8A and 8B within the range of the groove 3 formed in the pipe having an elliptical shape in the preceding grooving step. The punch 5 is substantially similar to the one described with reference to FIG. 5, and is in the shape of inverted V recessed from the ends to the central portion thereof as shown in FIG. 8A. Thus, the ends of the punch 5 are formed at an acute angle θ.

Further, as shown in FIG. 8B, a groove 5*a* recessed along the cutting edge is formed at the central portion along the thickness of the cutting edge of the punch 5. As the result of forming the groove 5*a,* the forward end of the cutting edge has a sectional shape formed at an acute angle. This shape of the cutting edge of the punch 5 reduces the load exerted vertically on the surface of the material, and also reduces the deformation amount Ad of the elliptical pipe 1 in the hole-making step thereby to prevent the elliptical pipe 1 from being crushed. At the same time, the punch 5 prevents the burrs 14 from being generated, which otherwise might be generated, as shown in FIG. 4.

Figure 9A:
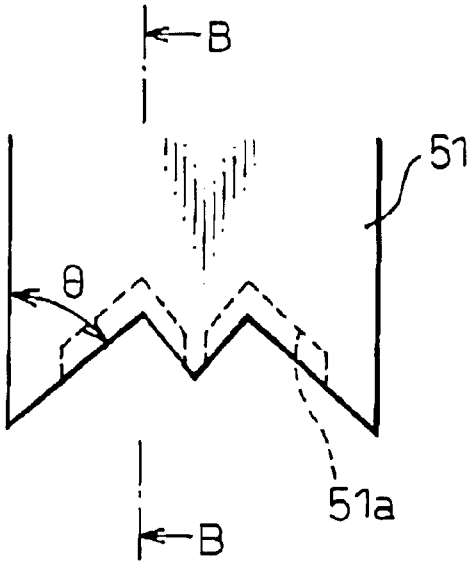
FIG. 9A is a front view showing a punch recessed in the shape of inverted W adapted for use according to this invention.
Figure 9B:
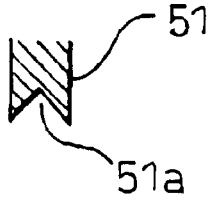
FIG. 9B is a side sectional view of the same punch taken in line B—B.

A punch 51 having a recessed portion in the shape of inverted W as shown in FIGS. 9A and 9B may be used as a modification of the punch adapted to replace the punch 5 having a recessed portion in the shape of inverted V. In such a case, the punch 51 is formed with a low protrusion at the central portion recessed from the ends thereof in the shape of inverted V, so that a groove 51*a* at the central portion along the thickness of the cutting edge is formed only along a part of the cutting edge to secure the strength of the cutting edge. The cutting position of the punch 5 or 51 shown in FIGS. 8 and 9 moves along the cutting edge thereof, and therefore substantially similar functions and effects are obtained from the two types of punch. The punches 5, 13, 51 only illustrate examples of the punch adapted to be used in the present invention, and therefore the detailed shape and structure of them are appropriately modifiable.

Figure 3:
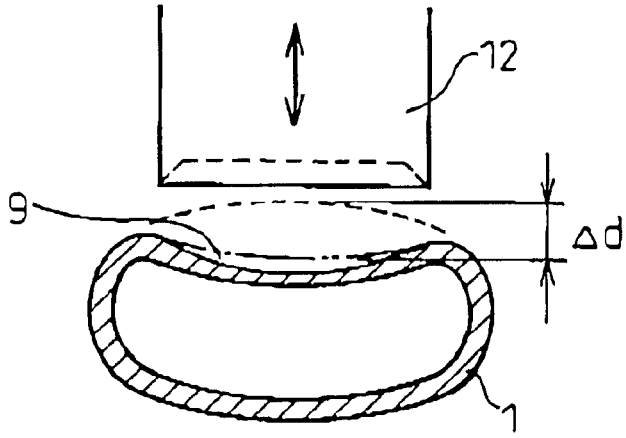
FIG. 3 is a sectional view for explaining the problem posed when using a normally shaped wide punch even though an elliptical pipe is grooved.
Figure 10A:
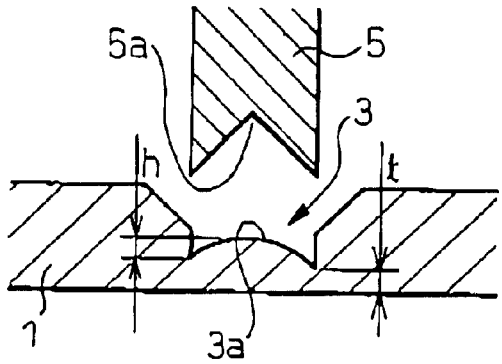
FIG. 10A is a sectional view showing the state immediately before a hole is made.
Figure 10B:
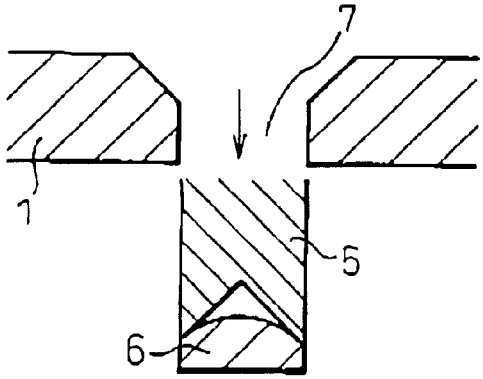
FIG. 10B is a sectional view showing the state immediately after the hole is made.

FIGS. 10A and 10B are enlarged sectional views of the essential parts of FIG. 1B showing the hole-making step and FIG. 1C showing the state after the hole-making step, respectively. As is apparent from FIGS. 10A and 10B, the cutting edge of the punch 5 shears the portion having the smallest thickness t of the elliptical pipe 1 longitudinally of the groove 3 formed in the grooving step, and the punch 5 is recessed in the shape of inverted V as shown in FIG. 8A. Thus, a lesser load is exerted on the elliptical pipe 1 at any time. For this reason, the slit 7 can be made by punching within the range of the groove 3 under a load considerably smaller than shown in FIG. 3. As a result, the likelihood is eliminated of the elliptical pipe 1 being crushed in the hole-making process.

The cutting chip 6 generated by making the slit 7 in the hole-making step is not left attached to a part of the peripheral edge of the slit 7 and is readily discharged in a small rounded form. This is by reason of the fact that, as shown in FIG. 7, the bottom portion of the groove 3 formed in the elliptical pipe 1 in the grooving step is formed with a ridge 3*a* having a height h, and a portion having a minimum thickness t remains at the foot thereof. The cutting edge of the punch 5 recessed in the shape of inverted V is kept in contact with the particular portion while moving toward the central portion from the ends of the groove. Further, the cutting chip 6 is pushed out while being supported by the groove 5*a* formed between the cutting edge portions of the punch 5, and therefore is not left at the edge portion of the slit 7. An experiment shows that the cutting chip 6 can be separated sufficiently even with the protrusions 3*a* having a height as small as about 0.2 mm.

Figure 11A:
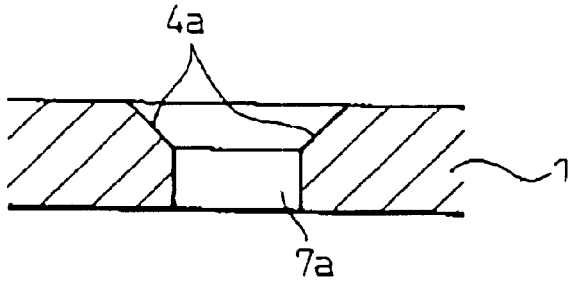
FIGS. 11A and 11B are sectional views showing the sectional shapes of slits formed after a groove is formed by different grooving punches, respectively.

FIG. 11A shows the shape of the section of the slit 7*a* made in the surface of the elliptical pipe 1 after the hole-making operation by the punch 5 following the grooving step using the grooving punch 2 shown in FIG. 6A. In the case where this method is implemented for fabricating the elliptical pipe 1 shown in FIG. 13 constituting the header tank of the heat exchanger 15 shown in FIG. 14, for example, the slanted surfaces 4 (4*a*) formed automatically on the surface of the elliptical pipe 1 by the grooving punch 2 guide each of the ends of a multiplicity of the core tubes 19 of the heat exchanger and facilitates the insertion thereof into the slits 7 (7*a*) when assembling the core tubes 19 on the header tanks constituted of the elliptical pipe 1.

Figure 11B:
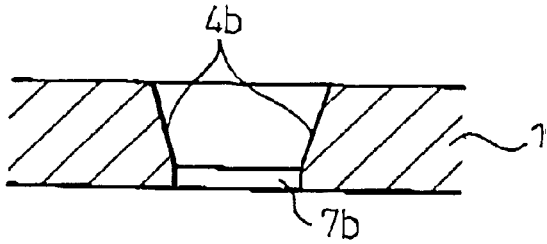

In similar fashion, the shape of the section of the slit 7*b* made in the grooving step using the grooving punch 21 shown in FIG. 6B and the hole-making step using the punch 5 is shown in FIG. 11B. The slanted surfaces 4*b* formed in this case also function in similar manner to the slanted surfaces 4*a* described above. As the result of forming the slanted surfaces 4 (4*a* or 4*b*), a wedge-shaped space is formed between the slanted surface 4 and the end surface of the core tube 19 of the heat exchanger 15, illustrated in FIG. 14, which is to be inserted into the slit 7. This wedge-shaped space is covered with a brazing material when brazing the core tube 19 to the elliptical pipe 1. Therefore, no strength problem is encountered.

Figure 12:
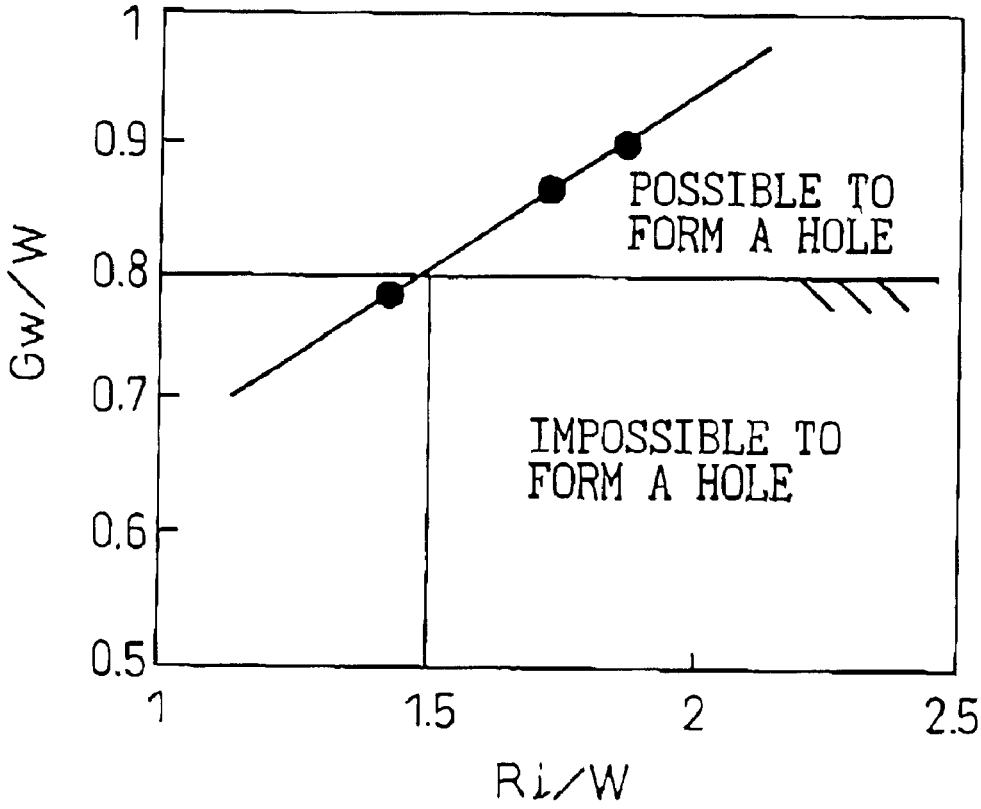
FIG. 12 is a diagram showing the range in which a hole is made by the hole-making method according to this invention.
Figure 12:
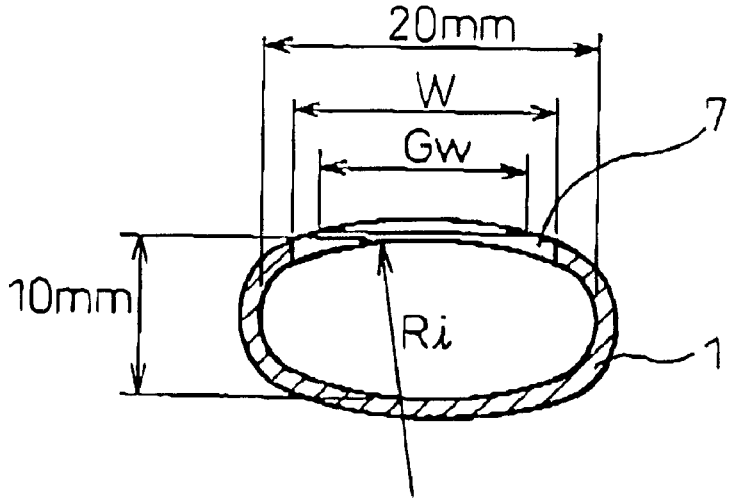

The method for making holes in a pipe according to this invention permits each slit 7 to be made efficiently in the elliptical pipe 1 without any die or metal core. In order to determine the limit to which a hole can be made by this method, an experiment for making a hole was repeatedly conducted using elliptical pipes having different radii of curvature. The result of the experiment is shown briefly in FIG. 12. In this experiment, a slit 7 having a length W of 16 mm was made in an aluminum pipe 1 as thick as 1.2 mm having an elliptical section with the interior having a long diameter of 20 mm and a short diameter of 10 mm. The experiment was conducted while changing the radius of curvature Ri of the interior and the length Gw of the groove 3 formed in the grooving step to determine whether the elliptical pipe 1 is crushed or not during the hole-making process.

Also in this experiment, the value Ri/W was changed by changing the radius of curvature Ri while at the same time changing the value Gw/W by changing the groove length Gw. As a result, it was found that the slit 7 can be made when Gw/W is 80% or more, but that in the case where Gw/W is less than 80%, i.e. the length W of the slit 7 (the length of the punch 5) is larger by 20% or more than the length Gw of the groove 3 formed in the grooving process, on the other hand, the elliptical pipe 1 is crushed under the pressure of the punch 5 and the slit 7 cannot be made. This is considered to be due to the fact that the effect of grooving is not exhibited when groove 3 is shorter than 80% of the length of the slit 7.

With the decrease in the radius of curvature Ri, even in the case where both the length Gw and the depth of the groove 3 are decreased at the same time, the possibility increases that the grooving punch 2 cuts through the pipe 1 in the grooving step. If the pipe 1 is Cut through by the grooving punch 2 in the grooving process, burrs remain at the machined portion. In the case where the burrs cannot be completely removed in the hole-making step with the punch 2, the quality of the elliptical pipe 1 as a product is adversely affected. As a result, even in the range of not smaller than 80% making possible the hole-making process in the diagram of FIG. 12, the area higher than the diagonal straight line shown in FIG. 12 cannot be actually employed. For this reason, the elliptical pipe 1 is required to have the radius of curvature Ri of such a magnitude that the grooving punch 2 does not cut through the elliptical pipe 1. That is to say, the ratio Ri/W is required to be not less than 1.5.

Figure 13:
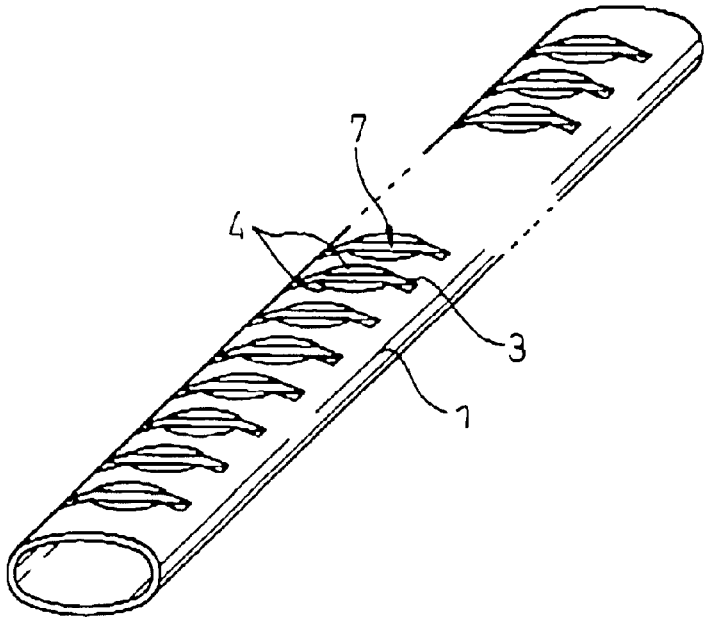
FIG. 13 is a perspective view illustrating an elliptical pipe as a completed product or a product in process.
Figure 14:
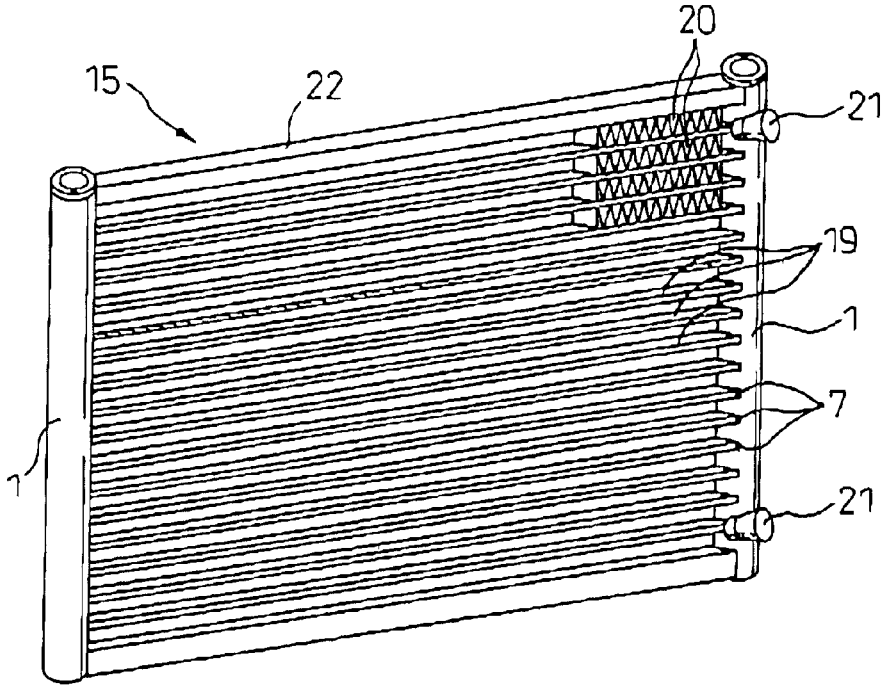
FIG. 14 is a perspective view illustrating a heat exchanger constituting a preferable application of the elliptical pipe.

A specific shape of the elliptical pipe 1 used as a header tank of the heat exchanger is illustrated in FIG. 13. In the case where the elliptical pipe 1 is used as a header tank with the heat exchanger 15 shown in FIG. 14, a multiplicity of slits 7 are formed in the left and right header tanks 1 by the method according to this invention, and the ends of a multiplicity of the core tubes 19 are brazed by being inserted into the holes 7. This insertion process is greatly facilitated by the method according to this invention in view of the fact that the slanted surfaces 4 are formed automatically in connection with the slits 7, respectively, when the slits 7 are made. In FIG. 14, reference numeral 20 designates corrugated fins arranged between adjacent core tubes 19, numeral 21 connectors arranged at the entrance of the fluid, and numeral 22 a side plate.

In fabricating a header tank constituted of the elliptical pipe 1 shown in FIG. 13, a multiplicity of slits 7 are made in parallel at predetermined spatial intervals. In embodying the present invention, therefore, a plurality of grooving punches 20 are desirably supported in parallel and operated at the same time by a single press in the grooving step. As a result, a plurality of grooves 3 can be formed at a time for improved production efficiency. In similar fashion, in the hole-making step, a plurality of punches 5 are desirably supported in parallel and operated at the same time by a single press thereby to make a plurality of slits 7 at a time.

The present invention is suitably applicable to the machining of the elliptical pipes I constituting header tanks in fabricating the heat exchanger 15 as illustrated in FIG. 14, and is of course usable also for making slits in a flat pipe. Also, the heat exchanger providing a suitable application for the present invention, as described above, includes a condenser, an evaporator and a heater for the climate control system, and a radiator and an oil cooler for an automotive engine.

What is claimed is:

1. A method of making narrow and elongated slits to insert and fix core tubes thereto in a surface of a pipe having an elliptical section by press-work without using a die or a metal core, said surface having a large radius of curvature along the long diameter of the elliptical section of the pipe, the method comprising:

a grooving step for forming a plurality of grooves in said pipe in the same direction as the length of each of said slits by operating a grooving punch having a predetermined shape in a direction along the length of the slit to be formed, and scraping off a part of said pipe to such a degree as not to cut through a wall of said pipe; and a hole-making step for making said slits in said groove formed in said grooving step in said pipe by operating a hole-making punch having a cutting edge comprising end portions thereof formed at an acute angle, cutting edge portions recessed from said end portions toward a central portion thereof and a depression formed between at least a part of said cutting edge portions to positively separate a cutting chip from the slit at the same time the slit is formed in a direction perpendicular to the length of each groove.

2. The method of making slits according to claim 1, wherein the length of said groove is not less than 80% of the length of said slit.

3. The method of making slits according to claim 2, wherein a ratio of the radius of curvature of the inner surface of said pipe to the length of each of said slits is not less than 1.5.

4. The method of making slits according to claim 1, wherein a ridge is formed on a bottom of each of said grooves along the length thereof in said grooving step so that the cutting chip generated by said hole-making punch in said slit making step is easily separated from the periphery of each of said slits.

5. The method of making slits according to claim 1, wherein a chamfer-like slanted surface on each side of each of said grooves is formed by said grooving punch at the same time that said groove is formed.

6. A method of making slits in a surface of a pipe having elliptical section according to claim 1, wherein said depression between cutting edge portions is formed in a part other than said end portion of said cutting edge.

7. A method of making slits in a surface of a pipe having an elliptical section according to claim 1, wherein said hole-making punch has end portions thereof formed at an acute angle and a central portion recessed in the shape of an inverted W.

* * * * *